United States Patent [19]

Ratajski

[11] Patent Number: 4,497,584

[45] Date of Patent: Feb. 5, 1985

[54] WRIST WATCH CASE WITH VULCANIZED GASKET

[75] Inventor: Michel Ratajski, Bienne, Switzerland

[73] Assignee: Firma H. Finger, Lengnau, Switzerland

[21] Appl. No.: 501,825

[22] Filed: Jun. 7, 1983

[30] Foreign Application Priority Data

Jun. 21, 1982 [CH] Switzerland ..... 3805/82

[51] Int. Cl.[3] ..... G04B 37/00

[52] U.S. Cl. ..... 368/294; 368/291; 368/290

[58] Field of Search ..... 368/294–296, 368/280, 276, 289–292

[56] References Cited

U.S. PATENT DOCUMENTS 3,643,424 2/1972 Simon ..... 368/291

FOREIGN PATENT DOCUMENTS 2463437 2/1981 France .
499148 5/1970 Switzerland .
2039099 7/1980 United Kingdom .
2057727 4/1981 United Kingdom .

*Primary Examiner*—Bernard Roskoski
*Attorney, Agent, or Firm*—Parkhurst & Oliff

[57] ABSTRACT

A case body is fixed to a glass by means of an interposed ring of a vulcanizable elastomer, this ring being bonded by vulcanization either directly to the glass or to a metallized coating applied to the glass, as well as to the upper surface of the case body. The metallic coating is applied to an annular zone at the periphery of the underside of the glass. Instead of this coating, the inside surface of the glass may be frosted in that zone.

15 Claims, 6 Drawing Figures

WRIST WATCH CASE WITH VULCANIZED GASKET

BACKGROUND OF THE INVENTION

This invention relates to watch cases, and particularly to a wrist watch case of the type having two or more parts including a glass. It is the result of research intended to improve watch case design from various points of view: reduction of the overall thickness of the case, greater attractiveness, increased invulnerability, especially as regards shock-resistance, and simplified structure.

The tendency toward reduction of the overall thickness of watches is currently inciting designers to use flat glasses of mineral material and to make them as thin as possible. The limitations in this respect depend upon the heat- und shock-resistance of the glass.

On the other hand, research with a view to making the cases more attractive is directed to producing glasses of hard mineral material which extend all the way to the periphery of the case, so that their whole edge is visible. This poses the problem of bonding the mineral material to the annular part intended to support it, the bezel or case body. This latter component may be either of metal or of some other relatively hard material and is generally opaque.

It has already been proposed in the art of watch-making to use shock-absorbing elements in the form of vulcanizable elastomeric rings placed between two metal rings and bonded to the latter by vulcanization in situ. A design of this type is described in Swiss Pat. No. 499,148, for example. The technique of joining an elastomeric component to a rigid support, especially of metal, is well known. The surfaces of the two components to be assembled are coated with organic binders in solution, suitable for the materials of which the components are made. The latter are placed in a mold at vulcanizing temperature. The elastomer is heated to flow temperature, then forced through one or more ducts into the space between the two components to be assembled and vulcanized along with the organic binders at a temperature between 200° and 300° C., depending upon the elastomer used. Vulcanization gives the elastomer its final structure, particularly its elasticity, while bringing about a very effective interfacial adherence between the elastomer and the supports.

The tensile strength obtained is on the order of 50–100 kg/sq.cm. Suitable elastomers are, for example, nitrile, butyl, neoprene, polyurethane, etc.

The same application can be envisaged with a plastomer as well. The thickness of the joint thus made adherent must be on the order of 0.3 to 0.5 mm; with polyurethane, the thickness may even be about 0.1 mm.

The vulcanization of elastomeric elements on metal supports has also been disclosed in connection with watch cases. According to U.K. Published Application No. 2,039,099, gaskets are bonded by this technique on shoulders of the parts supporting them; and French Published Application No. 2,463,437 describes a method consisting in lining the inside of the caseband of a watch case with a joint adhering to the caseband by vulcanization.

Yet these prior art applications did not represent an improvement from the point of view of either reduction of the thickness of the case or attractiveness or simplification. It has now been realized, however, that vulcanization yields reliable bonds on metallized glasses and that the strength obtained is compatible with the requirements to be met by watch cases.

SUMMARY OF THE INVENTION

It is therefore an object of this invention to provide an improved watch case having reduced overall thickness, greater attractiveness and sturdiness, and a simplified construction.

To this end, in the wrist watch case according to the present invention, a part of the case comprising the glass is joined to another part by an interposed ring of vulcanizable material having bonding surfaces adhering to matching surfaces of each of the case parts, the adherence being established by vulcanization.

The effect of this mode of binding between the part of the case comprising the glass and the other part of the case is that the glass is resiliently suspended, so that its shock-resistance is greatly improved. Moreover, stresses, especially of thermal origin, are no longer transmitted to the glass. This glass may take the form of a very thin plate of mineral material. This thickness of the glass can thus be reduced to about 0.4 mm without running the risks involved with such thin glasses fixed by prior art means.

BRIEF DESCRIPTION OF THE DRAWINGS

Preferred embodiments of the invention will now be described in detail with reference to the accompanying drawings, in which.

DESCRIPTION OF THE PREFERRED EMBODIMENTS

Figure 1:
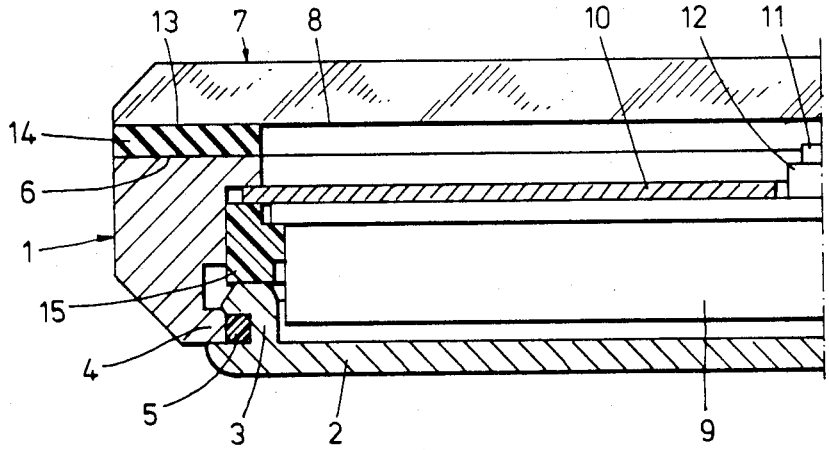
FIGS. 1 and 2 are partial axial sections through the watch case in two embodiments of the invention.

In FIG. 1, the wrist watch case comprises a first part formed by an annular case body 1 and a back 2 fixed to body 1 by a snap along the top edge of the sidewall 3 of back 2. Body 1 may be of steel, of gold, of some other metal, or of any other stable material suitable for making watch cases. Back 2 is generally of steel. Its peripheral wall 3 is snap-fitted to the lower rim 4 of case body 1, enclosing a gasket 5 between the two components. Body 1 is provided with means (not shown) for the attachment of a watch band, as well as with a transverse passage (also not shown) for the insertion of a control means.

The top of case body 1 is a plane annular face 6 about 2.5–3 mm wide. Body 1 may be round or shaped. In the embodiment shown in FIG. 1, face 6 extends uninterruptedly from the outer edge to the inner edge. Thus, in a man's watch having a diameter on the order of 30 mm, the area of top face 6 reaches 2–3 sq.cm.

The case comprises a second part which, in the embodiment of FIG. 1, consists solely of a thin, flat plate 7 of a transparent mineral material such as glass, or of a crystal such as sapphire. Glass 7 therefore has a plane underside 8 which covers a movement 9, a dial 10, and hand-fitting pipes 11 and 12. A thin layer of an opaque coating 13, consisting of a metal adhering to glass 7, is applied to the peripheral margin of surface 8, e.g., by vacuum metallization. As a modification, the peripheral margin of glass underside 8 might be frosted instead.

Glass 7 is bonded to case body 1 by means of an interposed ring 14 of a vulcanizable material, e.g., an elastomer, joined by adhesion of its underside to top face 6 of body 1, on the one hand, and of its upper surface to the metallized coating 13 or frosted margin of surface 8, on the other hand. Ring 14 is about 0.3 to 0.5 mm thick. Its cross-section, determined by the shape of the molds containing parts 1 and 7 during bonding, is rectangular, the outside surface being flush with that of body 1. The in situ vulcanization operation having been described above, it need not be repeated here. It will be seen that the effect of opaque metallized layer 13 is to mask ring 14, and that owing to this feature, glass 7 can extend to the very edge of the case, where it is visible in its entire thickness and around its whole circumference.

Movement 9 is fixed within body 1 by means of a casing-ring 15 which supports both dial 10 and the plate fillet of movement 9.

Figure 2:
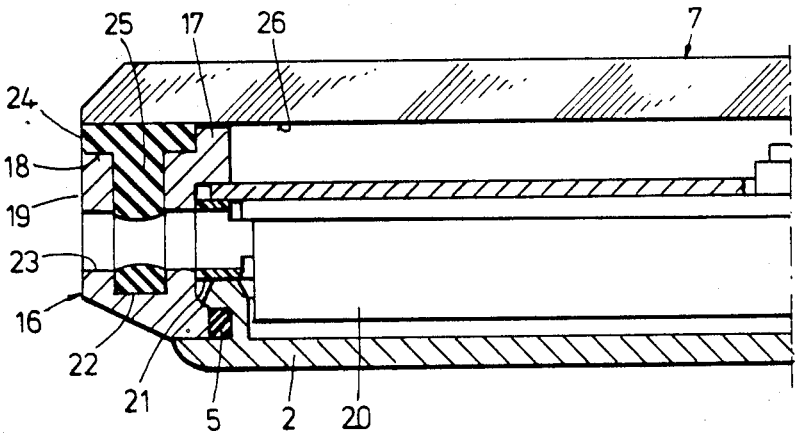

In the embodiment illustrated in FIG. 2, there is the same glass 7, again preferably of sapphire and extending all the way to the edge of the case. Here, the case body is an annular piece 16 having at the top a projecting rim 17 which forms the flange of the case. On the outside, rim 17 is encircled by a plane shoulder 18 extending to the side surface 19 of case body 16. As FIG. 2 is a section through 3 o'clock, the layout of the stem passage is visible; this passage is intended for the insertion of a control stem (not shown) disposed radially for acting upon the elements of a movement 20 fixed by means of a casing-ring 21 within case body 16. At the location of 3 o'clock there is a seat 22 contrived in the wall of body 16 starting from top shoulder 18. The bottom of seat 22 may be U-shaped. A bore 23 passes all the way through the wall of body 16; the axis of bore 23 coincides with that of the semicircular bottom of seat 22.

The bond between glass 7 and case body 16 being effected in this embodiment by means of an interposed ring 24 of a vulcanizable elastomer, it will be seen that ring 24 can be made integral with a filler 25 formed of the same material and acting as a gasket through which the control stem passes. When ring 24 is put in place, non-vulcanized material is also inserted into seat 22, care being taken to place in bore 23 beforehand a stem having a groove facing seat 22 so that after vulcanization, filler 25 forms a bulge protruding into the passage 23. As in the first embodiment, the marginal area of the underside 26 of glass 7 may be metallized or frosted. If desired, it may be left in its natural, smooth state instead. The case is closed at the bottom by a back 2 which may be the same as in the first embodiment, gasket 5 also being seated at the same place.

Figure 3:
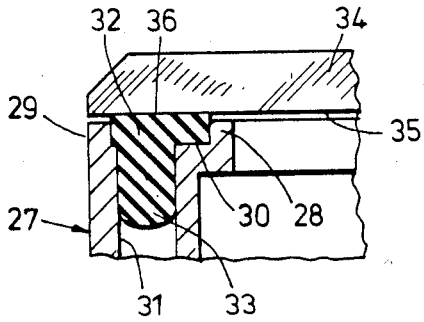
FIGS. 3–6 are sectional details of various modifications.

For both embodiments described above, the molds intended to contain the masses of elastomer forming ring 14 or ring 24 must have clearance spaces so that the elastomer can expand and give off gas during the vulcanization treatment. FIG. 3 shows a modification in which the seat intended to receive the interposed bonding ring has a shape making it possible to simplify production of the molds. Case body 27 here has a projecting inner rim 28 and a projecting outer rim 29, between which there extends a shoulder 30 forming a surface for bonding to an interposed ring 32. Various axial bores 31 are made in shoulder 30 so that when ring 32 is put in place, surplus material 33 can enter bores 31 and give off gas through these bores. A glass 34 shown in FIG. 3 is therefore bonded to case body 27 at the periphery of its underside 35, which may be metallized or frosted and is in contact with the top surface of ring 32, whereas ring 32 is masked both from above, by the metallized coating 36, as well as laterally inside and outside, by projecting rims 28 and 29.

Figure 4:
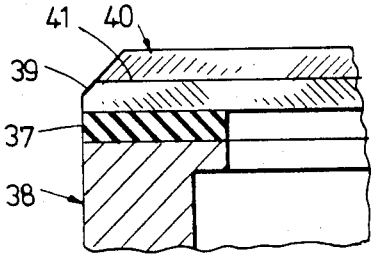

In a modification such as that of FIG. 4, the top surface of an interposed ring 37 bonded to a case body 38, as in the first embodiment, is joined to a thin piece 39 which may be either a transparent plate covering the whole case or an annular piece, the upper component of the glass being a plate 40 of mineral glass or sapphire cemented to piece 39. It may be plate 40 which bears the metallized coating 41 if piece 39 is transparent and if it is vulcanized directly onto ring 37 without any metallized coating.

It is possible to conceive of other embodiments of a watch case in which the part including the glass is bonded by means of a vulcanized ring to the main part, particularly to the part having the means of attachment for a watch band. Although in the embodiments described above, the interposed ring is vulcanized on a case body, it might equally well be vulcanized on a bezel. The rim of the latter might also encircle the glass.

In an embodiment such as is illustrated in FIG. 2, it would be possible to provide several transverse passages, e.g., for several pushbuttons in the case of a digital watch, by vulcanizing the gasket material in place, as shown in that drawing figure.

The glasses described above are flat, but the vulcanized ring constituting the bonding means would naturally lend itself very advantageously to a curved glass if it were desired to produce cases conforming to the shape of the wrist, for example.

The means of fixation described above may also be applied to organic glasses. As for the material of which the metallized layer is made, it may be any metal used for such operations, e.g., chromium.

Figure 5:
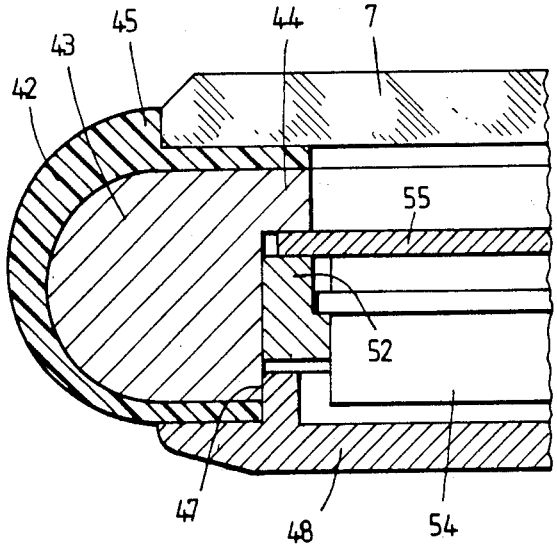

From the foregoing explanations, it follows that an embodiment such as that of FIG. 5 is also within the scope of the invention. Here, an interposed ring 42 surrounds and covers a caseband 43 which is preferably of metal and has an inside surface polished toward the top, forming a case flange 44, whereas the lower part of its inside surface is machined so that it can bear a casing-ring 52, fitted in the case from the back and in turn bearing a movement 54 and a dial 55.

The mold intended to receive the raw rubber will be fitted with parts 7 and 43 to be bonded. It will hold these parts during the vulcanizing operation and will be so formed as to give interposed ring 42 the size and outer shape of a caseband provided with a projecting rim 45 encircling glass 7 and with horns (not shown) for attaching the case to a watch band. A back 48 is detachably secured by means of a snap 47 on caseband 43. The lower edge of ring 42 acts as a gasket.

By means of today's technology relating to elastomers and to plastomers which can be transformed into a solid mass by vulcanization or an analogous process, it is possible to obtain an annular body such as the element 42 having an appearance and outside dimensions, as well as properties of hardness and elasticity, which answer very varied requirements precisely and reliably.

The arrangement according to FIG. 5 can thus be produced in many variations as regards the shape and the surface appearance, as well as the hardness and strength of the material. Rim 45 and the horns (not shown) can take on numerous forms, and rim 45 may even be done away with entirely. Ring 42 might cover only the lateral face of caseband 43, with a separate gasket being provided between the caseband and the back.

The watch band itself, or part of it, might be made of an elastomer and be formed at the same time and in the same mold as the case, so as to be joined thereto.

Figure 6:
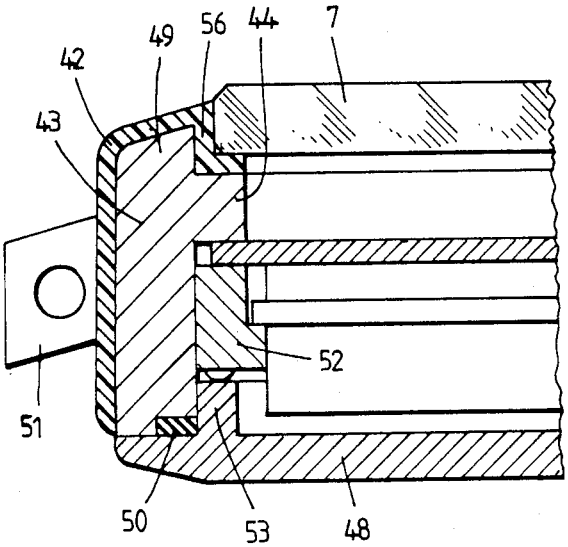

FIG. 6 illustrates one of the modifications referred to above. In this design, caseband 43 has a snap 49, and interposed ring 42 forms a molded-on facing of substantially uniform thickness; the portion 56 of ring 42 covering snap 49 adheres to the side face and to the marginal area of the underside of glass 7.

On the other hand, ring 42 extends downward only on the lateral face of caseband 43, so that a separate gasket 50 must be provided between the peripheral shoulder of the back 48 and caseband 43. FIG. 6 also shows means for connecting the case to a watch band, viz., a projecting element 51 formed of the same material as ring 42, with which it is integral. Element 51 may be a horn, a central lug, or any other form of attachment means.

As in the case of FIG. 5, provision is also made for an independent casing-ring 52 which may be fixed to the inside wall of caseband 43 or held between the rim 53 of the back and the lower shoulder of flange 44.

What is claimed is:

1. A wrist watch case comprising a glass and an annular case body, said glass being tightly secured to said case body along the periphery thereof, wherein a ring of vulcanizable material is interposed between said glass and said case body, said ring having bonding surfaces vulcanized to a matching surface of each one of said glass and case body, respectively, said case body further including an annular wall for encircling and securing a watch movement having one or more control stems protruding therefrom, said annular wall being traversed by one or more radial holes for receiving said one or more control stems, and said annular wall further having one or more recesses extending between said matching surface of said case body and said one or more radial holes, and said wrist watch case further comprising a mass of vulcanizable material integral with said ring partially filling said one or more recesses to form a gasket in contact with said one or more control stems.

2. The watch case of claim 1, wherein said glass is of mineral material, said ring being vulcanized to the peripheral area of the underside of said glass.

3. The watch case of claim 2, wherein said glass includes a metallized zone at the periphery of the underside thereof for masking said ring.

4. The watch case of claim 3, wherein said ring is vulcanized directly to said metallized zone.

5. The watch case of claim 1, wherein said glass includes a frosted annular surface portion to which said ring is vulcanized.

6. The watch case of claim 1, wherein said glass includes a polished surface to which said ring is directly vulcanized.

7. A wrist watch case comprising a glass and an annular case body, said glass being tightly secured to said case body along the periphery thereof, wherein a ring of vulcanizable material is interposed between said glass and said case body, said ring having bonding surfaces vulcanized to a matching surface of each one of said glass and case body, respectively, said case body having inner and outer projecting rims made in one piece therewith, said ring of vulcanizable material being disposed between said rims, and said case body further including a plurality of escape means allowing the placing of said vulcanizable material, the degassing thereof and the expansion thereof during fixation of said glass.

8. The watch case of claim 7, wherein said glass is of mineral material, said ring being vulcanized to the peripheral area of the underside of said glass.

9. The watch case of claim 8, wherein said glass includes a metallized zone at the periphery of the underside thereof for masking said ring.

10. The watch case of claim 9, wherein said ring is vulcanized directly to said metallized zone.

11. The watch case of claim 7, wherein said glass includes a frosted annular surface portion to which said ring is vulcanized.

12. The watch case of claim 7, wherein said glass includes a polished surface to which said ring is directly vulcanized.

13. A wrist watch case comprising a glass and an annular case body, said glass being tightly secured to said case body along the periphery thereof, wherein a ring of vulcanizable material is interposed between said glass and said case body, said ring having bonding surfaces vulcanized to a matching surface of each one of said glass and case body, respectively, and said matching surface of said case body entirely covering an outer side portion and an upper portion of said case body, said ring thus forming a sheath coating the outer portions of said case body and extending between said glass and said case body.

14. The wrist watch case of claim 12, wherein said ring sheath has a projecting rim at its upper portion which encircles said glass and extends above said case body.

15. The wrist watch case of claim 13, wherein said ring sheath comprises a lower edge portion covering a lower surface portion of said case body and said watch case comprises a removable back part having a side flange which contacts said lower edge portion, thus providing for tight closure of said case.

* * * * *